US006776749B1

(12) United States Patent
Hedayatpour

(10) Patent No.: US 6,776,749 B1
(45) Date of Patent: Aug. 17, 2004

(54) METHOD AND APPARATUS FOR A KEYCARD HOLDER WITH TWO DISTINCT POCKETS

(75) Inventor: Bahram Hedayatpour, San Luis Obispo, CA (US)

(73) Assignee: Kathy Sayah, San Luis Obispo, CA (US)

( * ) Notice: Subject to any disclaimer, the term of this patent is extended or adjusted under 35 U.S.C. 154(b) by 0 days.

(21) Appl. No.: 10/462,906

(22) Filed: Jun. 16, 2003

(51) Int. Cl.[7] ..... B31B 1/26; B31F 1/00

(52) U.S. Cl. ..... 493/405; 493/243; 493/254; 493/408; 493/409; 493/421

(58) Field of Search ..... 493/243, 244, 493/254, 405, 408, 409, 421; 206/37.1, 37.4; 229/72

(56) References Cited

U.S. PATENT DOCUMENTS 3,655,119 A * 4/1972 Thompson ..... 229/72
3,800,954 A * 4/1974 Lampcov ..... 210/497.2
4,109,850 A * 8/1978 Meenan et al. ..... 229/72
4,151,787 A * 5/1979 Rohr et al. ..... 493/244
4,620,630 A * 11/1986 Moss ..... 206/45.24
4,671,332 A * 6/1987 McPhee ..... 150/132
4,726,802 A * 2/1988 Volk, Jr. ..... 493/188
5,201,982 A * 4/1993 Schmidt ..... 156/227
6,290,634 B1 * 9/2001 Lombardo et al. ..... 493/188
6,635,003 B2 * 10/2003 Marchant ..... 493/231

* cited by examiner

*Primary Examiner*—Stephen F. Gerrity
*Assistant Examiner*—Hemant M. Desai
(74) *Attorney, Agent, or Firm*—Ali Kamarei, Esq.

(57) ABSTRACT

A device and method is disclosed for creating at least two pockets in a keycard holder comprising the steps of, cutting a piece of paper across one length at an angle between 20 and 30 degrees to the width, such that the width is approximately 6 inches on one side and the length is approximately between 5.5 and 6.5 inches on one side, folding the said paper in half across its length, folding the right and left edges of the width along the length in to meet at a midline, folding the left side over the right side along the midline to make a rectangle of approximately 2 ¾ by 4 ¼ inches, to create a first and second pocket.

24 Claims, 5 Drawing Sheets

METHOD AND APPARATUS FOR A KEYCARD HOLDER WITH TWO DISTINCT POCKETS

FIELD

This invention relates to a method of creating a keycard holder device with two pockets created by a single simple cut.

BACKGROUND

Traditionally, hotel restaurants have struggled to make a profit due to intense competition. For example, people have a general impression that hotel restaurants are there not because they serve good food, but because they are required to be there by the hotel. Thus far, most hotel restaurants rely on their in-room Guest Service Directory, a binder that is placed in every hotel room containing a menu and other hotel amenities, to promote the restaurant. However, this type of promotion is quite passive and few hotel guests read the content of such Guest Service Directories.

In response to this some have created keycard holders that will hold a keycard and that also contains information about the hotel and its services. But the majority of these keycard holders are printed on 80# (pound) to 100# cardstock and all require some form of die cut and or gluing, making the production process very costly, both because of the cost of the heavier paper, as well as the cost associated with special handling required for die cutting and/or gluing or other attachment mechanisms that are used. Furthermore, the die cut may not be complete, so the keycard holder cannot be easily inserted into the die cut.

To create a die cut specific and costly materials are required because a die cut is created by cutting through the center of a piece of stock without serration of the edges. However, many times the stock being die cut ends up tearing or folding as the blades of the die cutter become dull. Furthermore, sometimes the cut is not complete so the die cut must be punched out, resulting in wasted time and inconvenience. Each die cut also results in only one slit, so while more than one item may be inserted into the die cut, only one item is visible.

Other methods and apparatuses also require securing means such as glue, staples, or paperclips to form a pocket, which requires increased time, machinery, and materials, and is potentially more costly than our proposed method of creating the pockets. Furthermore, if glue was used it may weaken over time and constant use causing the pocket to fall off along with its contents. If staples are used they may tear out if caught on something, potentially damaging clothing and the keycard holder. Lastly, if paperclips are used, there is always the possibility that they may fall off or snag on something.

The present invention provides a keycard holder, which is designed to have two pockets, which allows for the insertion of a keycard into one pocket and informational material, such as that of the hotel restaurant menu or map, into the second pocket. This invention is designed to fit inside a wallet or pocket to be truly portable, thus, the restaurant menu is available to the guest even when they are not at the hotel and can easily compare choice of foods and prices when they are away from the hotel. Furthermore, because the informational material (restaurant menu) is not permanently attached to or printed upon the keycard holder, it can easily be replaced if updated material becomes available.

Thus, an objective is that a key holder device be less costly to manufacture by eliminating any die cut and the elimination of the need for gluing, staples, or other attachment or securing mechanisms.

A further objective is that the key holder device be readily transportable. Yet another objective is that a menu from an area restaurant or a map of the surrounding area be easily inserted into the keycard holder and thus, be accessible and provide valuable information to the hotel's clientele.

Yet another objective is that single cut result in the formation of two distinct pockets located at the different areas of the keycard holder to accommodate more than one informational material.

Yet another feature of the keycard holder is that the informational material be not bound to the holder, so updated informational material can easily replace old informational material.

SUMMARY

A method is disclosed for creating at least two pockets in a keycard holder comprising the steps of, cutting a piece of paper across one length at an angle between 20 and 30 degrees to the width, such that the width is approximately 6 inches on one side and the length is approximately between 5.5 and 6.5 inches on one side, folding the said paper in half across its length, folding the right and left edges of the width along the length in to meet at a midline, folding the left side over the right side along the midline to make a rectangle of approximately 2¾ by 4¼ inches, to create a first and second pocket.

In this method no die cut is used to create the pockets. Also in this method, no glue, staples, paperclips, or other cut is required to create the pockets.

The method uses paper that is light weight, easily cut, and takes a permanent fold. The paper preferably will receive printing and can be marked by ordinary pen and pencil. Optionally, the paper is 8½ by 11 inch, between text 20 pound paper and text 100 pound paper. Preferably, the paper is 8½ by 11 inch, text 50 pound paper.

As an option, the paper is printed on one or both sides. The described keycard holder thus, is designed to receive a key card optionally into the first pocket, and/or a menu or map into the second pocket.

The device of the invention is a keycard holder comprising at lease two pockets formed by cutting a piece of paper cut across the length at an angle between 20 and 30 degrees to the width, such that the width is approximately 6 inches on one side and the length is approximately between 5.5 and 6.5 inches on one side folding the said paper in half across its length, folding the right and left edges along the width in to meet the midline, and then folding the left side over the right side to make a rectangle approximately 2¾ by 4¼ inches, to create a first and second pocket.

DETAILED DESCRIPTION

Figure 1:
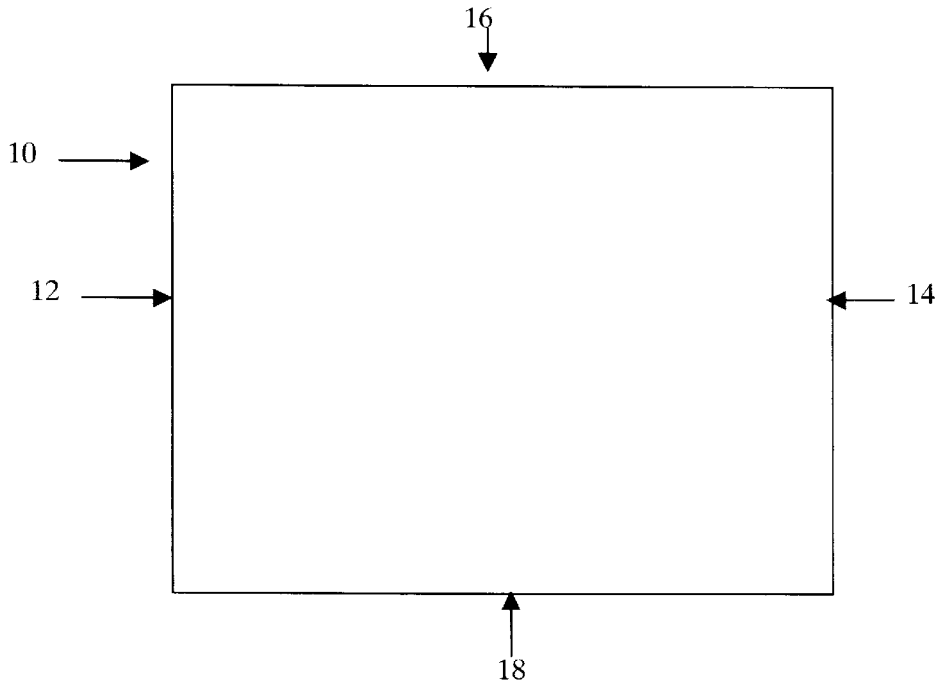
FIG. 1 shows a simple 8 and one half inches by 11 inch size paper starting material.

The present invention consists briefly of an 8 and one half inch by 11 inch sheet of paper 10, having a left edge 12 and right edge 14 of eight and one half inches, and top edge 16, and bottom edge 18 of 11 inches. The paper thickness is optionally selected from as thin as 20# text paper or as thick as 100# text paper. Most preferably, the thickness of the paper is 50# text paper.

Figure 2A:
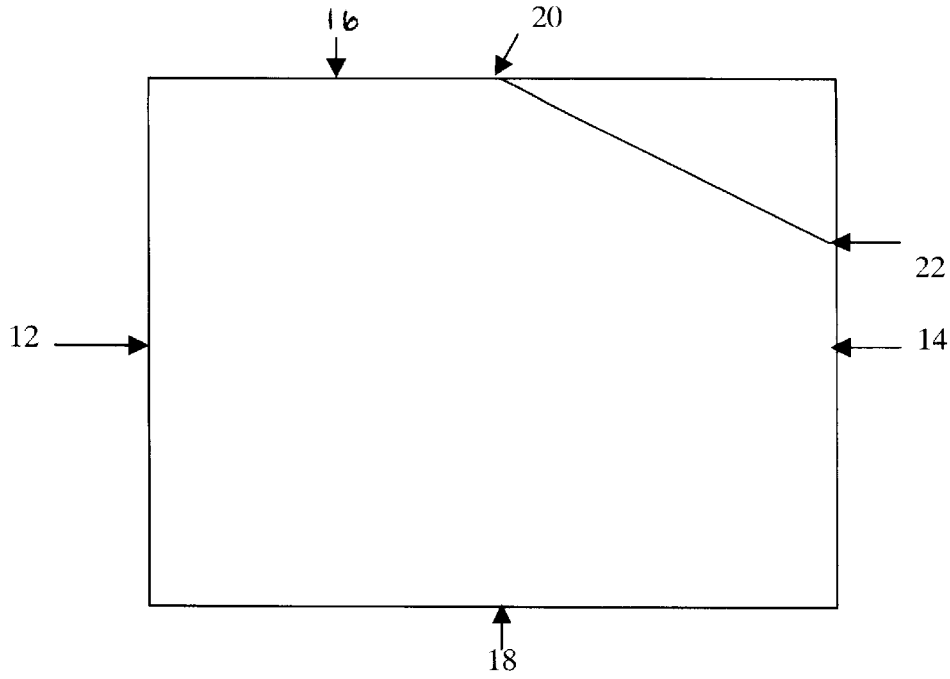
FIG. 2 shows a simple cut from one length of the paper to one width of the paper and the formation of a diagonal edge.
Figure 2B:
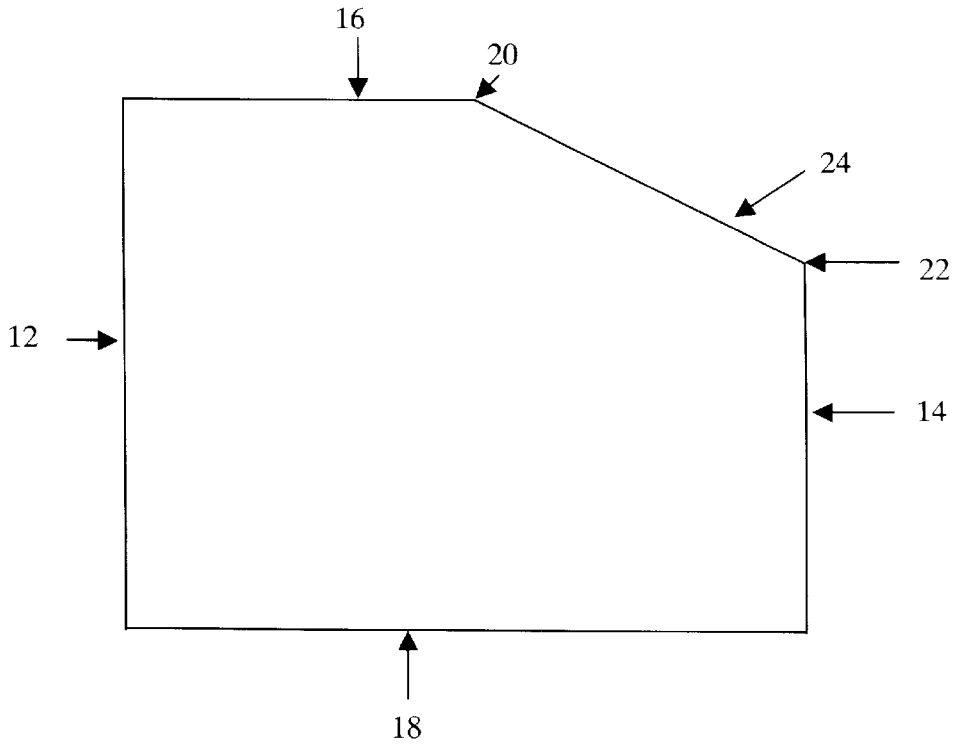
Figure 3A:
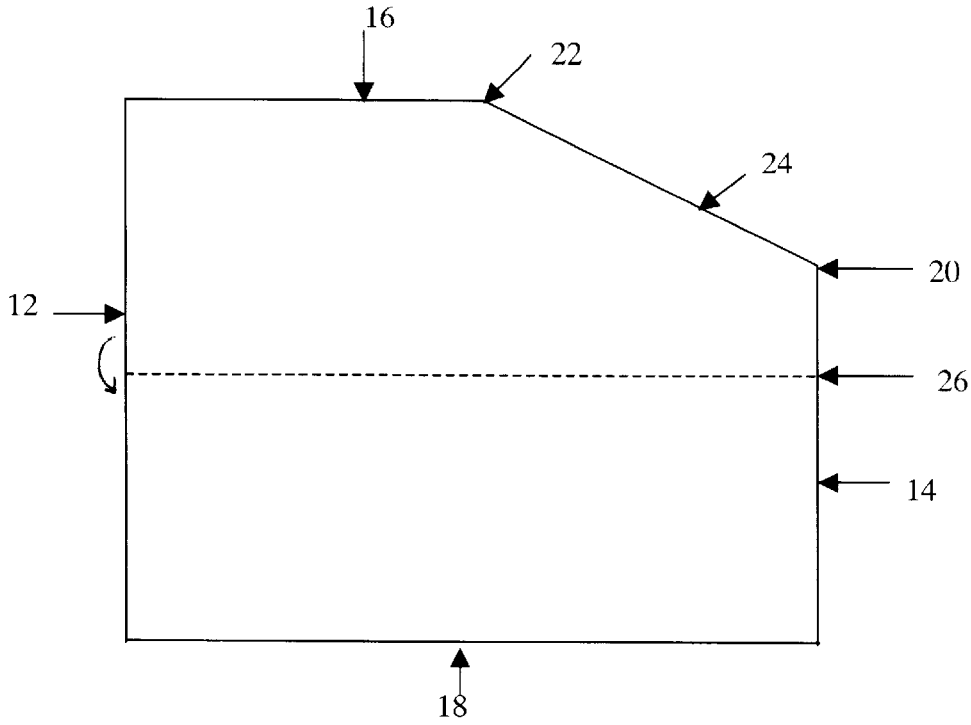
FIG. 3 shows the folding of the paper substantially in half to form a paper of approximately 4.25 inches by 11 inches.
Figure 3B:
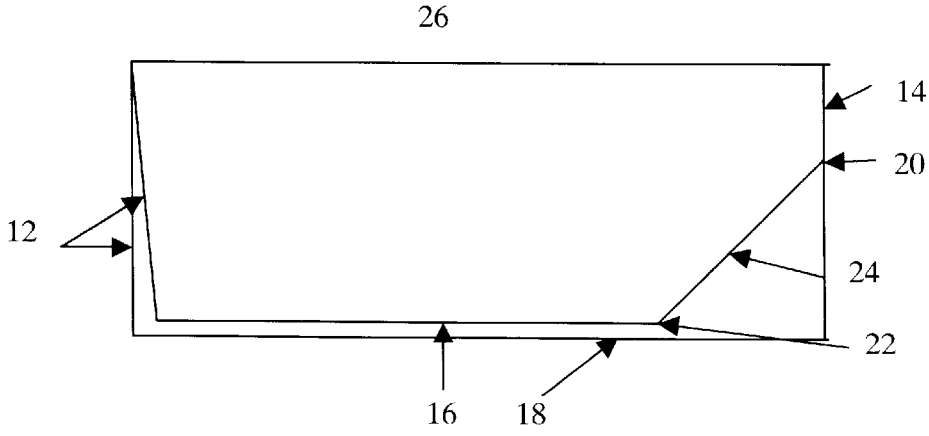
Figure 4A:
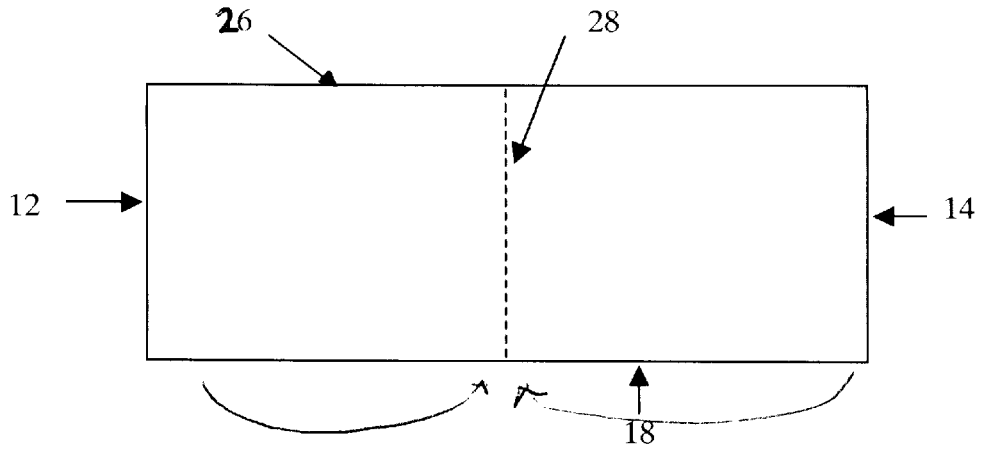
FIG. 4*a–c* shows the folding of the 4.25 inches by 11 inches paper to meet at a center line to form a cardholder device of approximately 4.25 inches by 5.5.
Figure 4B:
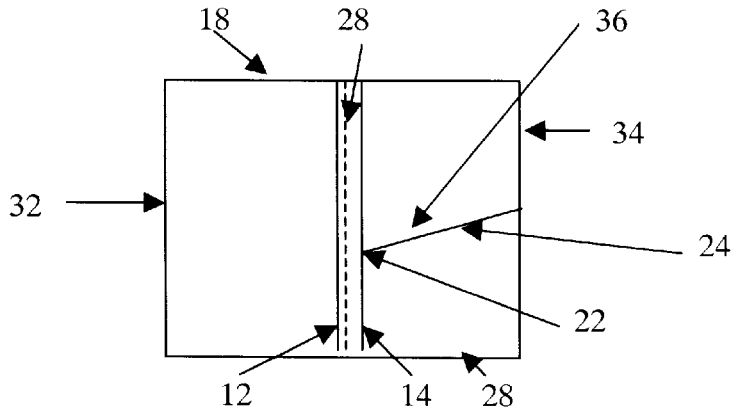
Figure 4C:
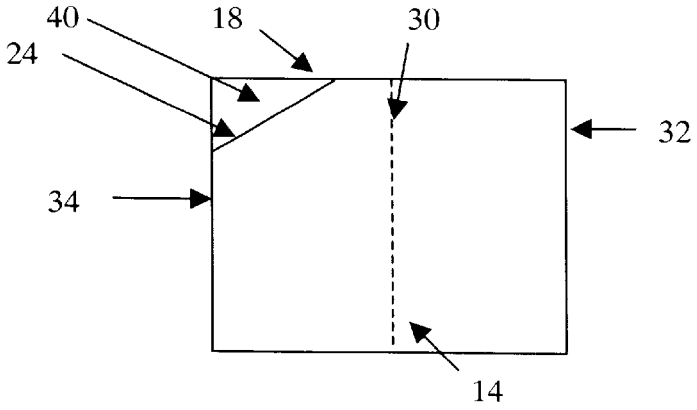

To construct the keycard holder of the present invention, a single simple cut is made across one length of the flat piece of paper 10 at an angle between 20 and 30 degrees, to one width of the paper 10, such as that shown in FIG. 2(*a*), between points 20 and 22. Thus, a simple diagonal straight edge 24 is formed. The cut should be made such that one width, for example right edge 14, is approximately between 14 and 16 centimeters long, and more preferably, is approximately 15 centimeters long, and one length, for example top edge 16 is now between 15 and 17 centimeters long and more preferably approximately 16 centimeters long. Then, as is shown in FIG. 3(*a*), the top edge 16 is folded over bottom edge 18, substantially across the centerline 26, to from a rectangle paper of approximately 4.25 by 11 inches as is shown in FIG. 3(*b*). Continuing to FIG. 4*a*, the paper 10 of FIG. 3*b* is turned over so that straight edge cut 24 is not seen. Right edge 14 and left edge 12 are then folded in to meet at midline 28, such that the paper size is now reduced to a rectangle of approximately 4.25 by 5.5 inches. The keycard holder is then rotated 180 degrees so that on the right side of the keycard holder device, there is now visible straight diagonal edge 24, which together with bottom edge 18, forms an inner first pocket 36, and creating new left edge 32 and new right edge 34. If the keycard holder is turned over, the same straight diagonal edge 24 and bottom edge 18 form a back second pocket 40, as is shown in FIG. 4*c*.

Figure 5A:
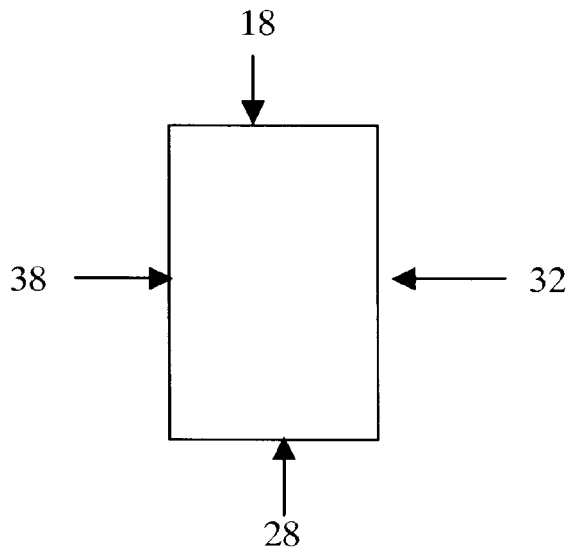
FIG. 5*a* shows the front view of the keycard holder device of approximately 2¾ by 4¼ inches.
Figure 5B:
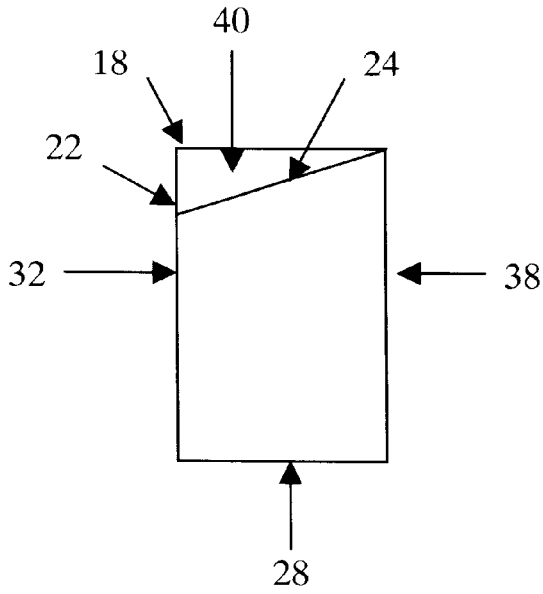
FIG. 5*b* shows the back view of keycard holder device with back pocket 40.

Lastly, folding the left fold edge 32 over the right fold edge 34, substantially across the midline 28 to make a key holder device that is a rectangle of approximately 2¾ by 4¼ inches. This results in an inner pocket 36 upon opening the keycard holder and a back second pocket 40 located on the backside of the keycard holder. FIG. 5 shows the completed device of the keycard holder invention.

Optionally, paper 10 is printed on, either on one side or both, preferably before diagonal cut 24 is made. For the writing to appear after the method above is completed, the printing should be on the backside of the paper before beginning. Thus, it can be seen how a simple cut from point 20 to 22, folding the sheet into substantially equal first and second portions along its length 26, then folding the right 14 and left 12 edges of the sheet to the midline 28 and then again folding the left 32 side to the right 34, to form a rectangle, with a pocket evident upon opening the key card holder and on the back side of the key card holder.

The paper may be of any material which is light weight, easily cut, and will take a permanent fold. The stock would preferably receive printing and could be marked on by ordinary pen and pencil. Most all types of paper will serve as well as some plastics and coated plastics. Optionally, 8½ by 11 inch, 20 to 100 pound matte finished text paper is used.

This method is advantageous because a die cut is not necessary to create the pockets. The method of this invention does not require special equipment or securing means. Instead, a simple straight edge cut and a series of folds are the only essential requirements. Thus, information will not be lost due to pockets falling off or tearing out. Further, the pockets are easily accessible and informational cards are inserted effortlessly and expired material can be replaced with updated material without damage to the keycard holder because actual pockets are formed when the paper is folded. An additional advantage of the two individual pockets is that a keycard may be inserted into the first pocket and informational material, such as a menu or map of the surrounding area, may be inserted into the back pocket, both being readily visible. Further, more than one packet containing informational material can fit inside the pocket allowing for greater advertising of services.

When a layout of the hotel or a guest service directory are printed on the keycard holder, it reduces the amount of paper that a guest is inundated with when they check in, increasing the likelihood that they will look at and use the information. Furthermore, because it is pocket sized the keycard holder and informational material travel easily, making the information accessible even when not in their room.

Thus, it can be seen how the objectives of the invention are achieved. A feature of the invention is that the key holder device is less costly to manufacture, because of the elimination of the die cut and the elimination of the need for gluing, staples, or other attachment or securing mechanisms.

A further feature of this device is that the key holder device is readily transportable because of its size. Yet another feature of this device is that a menu from an area restaurant or a map of the surrounding area is also easily inserted into its pockets and thus, accessible and provides valuable information to the hotel's clientele.

Yet another feature of the keycard holder is that a simple single cut results in the formation of two distinct pockets located at the different areas of the card holder of the invention, to accommodate more than one informational packet, in addition to the keycard.

Yet another feature of the keycard holder is that the informational material is not bound to the holder, so updated informational material can be easily replace old information material.

The invention has been described in connection with what is presently considered to be the most practical and preferred embodiments. However, the above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A method of creating at least two pockets in a keycard holder comprising the steps of:

a. cutting a piece of paper across one length at an angle between 20 and 30 degrees to width, such that the width is approximately 6 inches on one side and the length is approximately between 5.5 and 6.5 inches on one side b. folding said paper in half across its length, c. folding right and left edges of the width along the length in to meet at a midline, d. folding the left side over the right side along the midline to make a rectangle of approximately 2¾ by 4¼ inches, to create a first and second pocket.

2. The method of claim 1 wherein no die cut is used to create the pockets.

3. The method of claim 1 wherein no glue, staples, paperclips, or other cut is required to create the pockets.

4. The method of claim 1 wherein the paper is light weight, easily cut, and takes a permanent fold.

5. The method of claim 4 wherein the paper will receive printing and can be marked by ordinary pen and pencil.

6. The method of claim 4 wherein the paper is 8½ by 11 inch, between approximately text 20 pound paper and text 100 pound paper.

7. The method of claim 4 wherein the paper is 8½ by 11 inch, text 50 pound paper.

8. The method of claim 1 wherein one side of the paper is printed on.

9. The method of claim 1 wherein both sides of the paper is printed on.

10. The method of claim 1 wherein a key card is inserted into the first pocket.

11. The method of claim 1 wherein a menu is inserted into the second pocket.

12. The method of claim 1 wherein a map is inserted into the second pocket.

13. A room keycard holder comprising at lease two pockets formed by cutting a piece of paper across length at an angle between 20 and 30 degrees to width, such that the width is approximately 6 inches on one side and the length is approximately between 5.5 and 6.5 inches on one side, folding said paper in half across its length, folding right and left edges along the width in to meet the midline, and then folding the left side over the right side to make a rectangle approximately 2¾ by 4¼ inches, to create a first and second pocket.

14. The device of claim 13 wherein the paper is light weight, easily cut, and takes a permanent fold.

15. The device of claim 13 wherein the material will receive printing and can be marked by ordinary pen and pencil.

16. The device of claim 13 wherein the material is 8½ by 11 inch, between approximately text 20 pound paper and text 100 pound paper.

17. The device of claim 13 wherein the material is 8½ by 11 inch, text 50 pound paper.

18. The device of claim 13 wherein the material has a matte finish.

19. The device of claim 13 wherein a menu is inserted into the second pocket.

20. The device of claim 13 wherein a map is inserted into the second pocket.

21. The device of claim 13 wherein no die cut is used to create the pockets.

22. The device of claim 13 wherein one side of the paper is printed on.

23. The device of claim 13 wherein both sides of the paper is printed on.

24. The device of claim 13 wherein no glue, staples, paperclips, or other cut is needed to create the pockets.

* * * * *